US007183884B2

(12) United States Patent
Shen et al.

(10) Patent No.: US 7,183,884 B2
(45) Date of Patent: Feb. 27, 2007

(54) MICRO MAGNETIC NON-LATCHING SWITCHES AND METHODS OF MAKING SAME

(75) Inventors: Jun Shen, Phoenix, AZ (US); Meichun Ruan, Tempe, AZ (US)

(73) Assignee: Schneider Electric Industries SAS, Rueil-Malmaison (FR)

( * ) Notice: Subject to any disclaimer, the term of this patent is extended or adjusted under 35 U.S.C. 154(b) by 0 days.

(21) Appl. No.: 10/684,587

(22) Filed: Oct. 15, 2003

(65) Prior Publication Data

US 2005/0083156 A1 Apr. 21, 2005

(51) Int. Cl.
*H01H 51/22* (2006.01)

(52) U.S. Cl. ..... 335/78

(58) Field of Classification Search ..... 335/78; 200/181

See application file for complete search history.

(56) References Cited

U.S. PATENT DOCUMENTS

| | | | |
|---|---|---|---|
| 4,065,677 | A | 12/1977 | Micheron et al. |
| 4,461,968 | A | 7/1984 | Kolm et al. |
| 4,496,211 | A | 1/1985 | Daniel |
| 4,570,139 | A | 2/1986 | Kroll |
| 5,016,978 | A | 5/1991 | Fargette et al. |

(Continued)

FOREIGN PATENT DOCUMENTS

| | | | |
|---|---|---|---|
| DE | 19820821 | C1 | 12/1999 |

(Continued)

OTHER PUBLICATIONS

Richard P. Feymann, "There's Plenty of Room at the Bottom", Dec. 29, 1959, pp. 1-12, Internet Source: http://222.zyvex.com/nanotech/feynman.html.

(Continued)

*Primary Examiner*—Elvin Enad
*Assistant Examiner*—Bernard Rojas
(74) *Attorney, Agent, or Firm*—Sterne, Kessler, Goldstein & Fox P.L.L.C.

(57) ABSTRACT

A micro magnetic switch includes a reference plane and a magnet located proximate to a supporting structure. The magnet produces a first magnetic field with uniformly spaced field lines approximately orthogonal to the reference plane, symmetrically spaced about a central axis, or non-uniformly spaced fields approximately orthogonal to the reference plane. The switch also includes a cantilever supported by the support structure. The cantilever has an axis of rotation lying in the reference plane and has magnetic material that makes the cantilever sensitive to the first magnetic field, such that the cantilever is configured to rotate about the axis of rotation between first and second states. The switch further includes a conductor located proximate to the supporting structure and the cantilever. The conductor is configured to conduct a current. The current produces a second magnetic field having a component approximately parallel to the reference plane and approximately perpendicular to the rotational axis of the cantilever, which causes the cantilever to switch between the first and second states. The switch still further includes a stopping device located proximate to the supporting structure. The stopping device is operable to stop the cantilever from rotating about the axis of symmetry beyond a point at which a longitudinal axis of the cantilever is approximately parallel to a longitudinal axis of the magnet.

12 Claims, 5 Drawing Sheets

U.S. PATENT DOCUMENTS

| | | | | |
|---|---|---|---|---|
| 5,048,912 | A | 9/1991 | Kunikane et al. | |
| 5,398,011 | A | 3/1995 | Kimura et al. | |
| 5,472,539 | A | 12/1995 | Saia et al. | |
| 5,475,353 | A | 12/1995 | Roshen et al. | |
| 5,557,132 | A | 9/1996 | Takahashi | |
| 5,629,918 | A | 5/1997 | Ho et al. | |
| 5,696,619 | A | 12/1997 | Knipe et al. | |
| 5,784,190 | A | 7/1998 | Worley | |
| 5,818,316 | A | 10/1998 | Shen et al. | |
| 5,838,847 | A | 11/1998 | Pan et al. | |
| 5,847,631 | A | 12/1998 | Taylor et al. | |
| 5,898,515 | A | 4/1999 | Furlani et al. | |
| 5,945,898 | A | 8/1999 | Judy et al. | |
| 5,982,554 | A | 11/1999 | Goldstein et al. | |
| 6,016,092 | A | 1/2000 | Qiu et al. | |
| 6,016,095 | A | 1/2000 | Herbert | |
| 6,028,689 | A | 2/2000 | Michalicek et al. | |
| 6,078,016 | A | 6/2000 | Yoshikawa et al. | |
| 6,084,281 | A | 7/2000 | Fullin et al. | |
| 6,094,116 | A | 7/2000 | Tai et al. | |
| 6,094,293 | A | 7/2000 | Yokoyama et al. | |
| 6,115,231 | A | 9/2000 | Shirakawa | |
| 6,124,650 | A | 9/2000 | Bishop et al. | |
| 6,143,997 | A | 11/2000 | Feng et al. | |
| 6,160,230 | A | 12/2000 | McMillan et al. | |
| 6,633,212 | B1 * | 10/2003 | Ruan et al. | 335/78 |
| 6,750,745 | B1 * | 6/2004 | Wei et al. | 335/78 |
| 6,794,965 | B2 * | 9/2004 | Shen et al. | 335/78 |

FOREIGN PATENT DOCUMENTS

| | | | |
|---|---|---|---|
| DE | 10031569 | A1 | 2/2001 |
| EP | 0452012 | A2 | 10/1991 |
| EP | 0452012 | A3 | 10/1991 |
| EP | 0685864 | A1 | 12/1995 |
| EP | 0709911 | A2 | 5/1996 |
| EP | 0709911 | A3 | 5/1996 |
| EP | 0780858 | A1 | 6/1997 |
| EP | 0887879 | A1 | 6/1998 |
| EP | 0869519 | A1 | 10/1998 |
| EP | 887879 | A1 | 12/1998 |
| FR | 2572546 | A1 | 5/1986 |
| JP | 54-161952 | | 12/1979 |
| JP | 4-275519 | | 10/1992 |
| JP | 6-251684 | | 9/1994 |
| WO | WO 97/39468 | | 10/1997 |
| WO | WO 98/34269 | | 8/1998 |

OTHER PUBLICATIONS

E. Fullin, J. Gobet, H.A.C. Tilmans, and J. Bergvist, "A New Basic Technology for Magnetic Micro-Actuators", pp. 143-147.

Jack W. Judy and Richard S. Muller "Magnetically Actuated, Addressable Microstructures", Sep. 1997, Journal of Microelectromechanical Systems, vol. 6, No. 3, Sep. 1997, pp. 249-255.

Ezekiel JJ Kruglick and Kristofer SJ Pister, "Project Overview: Micro-Relays", Tech. Digital Solid-State Sensor and Actuator Workshop, 1998, Hilton Head 98 and 19th International Conference on Electric Contact Phenomena, Nuremberg, Germany, Sep. 1998 (Downloaded from Internet Source: http://www-bsac.eecs.berkeley.edu/Kruglick/relays/relays.html, on Jul. 12, 1999) 2 pgs.

Ezekiel J.J. Kruglick and Kristofer S.J. Pister, "Bistable MEMS Relays and Contact Characterization", Tech. Digital Solid-State Sensor and Actuator Workshop, Hilton Head, 1988 and 19th International Conference on Electric Contact Phenomena, Nuremberg, Germany, Sep. 1998, 5 pgs.

Laure K. Lagorce and Olive Brand, "Magnetic Microactuators Based on Polymer Magnets", Mar. 1999, IEEE Journal of Microelectromechanical Systems, IEEE, vol. 8., No. 1., Mar. 1999, 8 pages.

"P10D Electricity & Magnetism Lecture 14", Internet Source: http://scitec.uwhichill.edu.bb/cmp/online/P10D/Lecture14/lect14.htn, Jan. 3, 2000, pp. 1-5.

"Ultraminiature Magnetic Latching to 5-relays SPDT DC TO C Band", Series RF 341, product information from Teledyne Relays, 1998.

M. Ruan et al., "Latching Microelectromagnetic Relays", Sensors and Actuators A 91 (Jul. 15, 2001), Copyright 2001 Elsevier Science B.V., pp. 346-350.

Xi-Qing Sun, K.R. Farmer, W.N. Carr, "A Bistable Microrelay Based on Two-Segment Multimorph Cantilever Actuators", 11th Annual Workshop on Micro Electrical Mechanical Systems, Heidelberg, Germany, IEEE, Jan. 25-29, 1998, pp. 154-159.

William P. Taylor and Mark G. Allen, "Integrated Magnetic Microrelays: Normally Open, Normally Closed, and Multi-Pole Devices", 1997 International Conference on Solid-State Sensors and Actuators, IEEE, Jun. 16-19, 1997, pp. 1149-1152.

William P. Taylor, Oliver Brand, and Mark G. Allen. "Fully Integrated Magnetically Actuated Micromachined Relays", Journal of Microelectromechanical Systems, IEEE, vol. 7, No. 2, Jun. 1998, pp. 181-191.

Tilmans, et al., "A Fully-Packaged Electromagnetic Microrelay", Proc. MEMS '99, Orlando, FL, Jan. 17-21, 1999, copyright IEEE 1999, pp. 25-30.

William Trimmer, "The Scaling of Micromechanical Devices", Internet Source: http://home.earthlink.net/-trimmerw/mems/scale.html on Jan. 3, 2000 (adapted from article Microrobots and Micromechanical Systems by W.S.N. Trimmer, Sensors and Actuators, vol. 19, No. 3, Sep. 1989, pp. 267-287, and other sources).

John A. Wright and Yu-Chong Tai, "Micro-Miniature Electromagnetic Switches Fabricated Using MEMS Technology", Proceedings: 46th Annual International Relay Conference: NARM '98, Apr. 1998, pp. 13-1 to 13-4.

John A. Wright, Yu-Chong Tai and Gerald Lilienthal, "A Magnetostatic MEMS Switch for DC Brushless Motor Commutation", Proceedings Solid State Sensor and Actuator Workshop, Hilton Head, Jun. 1998, pp. 304-307.

John A. Wright, Yu-Chong Tai, and Shih-Chia Chang, "A Large-Force, Fully-Integrated MEMS Magnetic Actuator", Tranducers '97, 1997 International Conference on Solid State Sensors and Actuators, Chicago, Jun. 16-19, 1997.

Ann, Chong H. & Allen, Mark G., A Fully Integrated Micromagnetic Actuator With a Multilevel Meander Magnetic Core, 1992 IEEE, Solid-State Sensor and Actuator Workshop, Technical Digest, Hilton Head Island, South Carolina, Jun. 22-25, 1992, Technical Digest, pp. 14-17.

English-Language Abstract of DE 10031569, published Feb. 1, 2001, 1 page.

English-Language Abstract of DE 19820821, published Dec. 16, 1999, 1 page.

English-Language Abstract of EP 0780858, published Jun. 25, 1997, 1 page.

English-Language Abstract of EP 0869519, published Oct. 7, 1998, 1 page.

English-Language Abstract of FR 2572546, published May 2, 1986, 1 page.

English-Language Abstract of JP 4275519, published Oct. 1, 1992, 1 page.

* cited by examiner

MICRO MAGNETIC NON-LATCHING SWITCHES AND METHODS OF MAKING SAME

BACKGROUND OF THE INVENTION

1. Field of the Invention

The present invention relates to non-latching electronic switches. More specifically, the present invention relates to a non-latching micro magnetic switch.

2. Background Art

Switches are typically electrically controlled two-state devices that open and close contacts to effect operation of devices in an electrical or optical circuit. Relays, for example, typically function as switches that activate or de-activate portions of electrical, optical, or other devices. Relays are commonly used in many applications including telecommunications, radio frequency (RF) communications, portable electronics, consumer and industrial electronics, aerospace, and other systems. More recently, optical switches implemented with relays (also referred to as "optical relays" or simply "relays" herein) have been used to switch optical signals (such as those in optical communication systems) from one path to another.

Although the earliest relays were mechanical or solid-state devices, recent developments in micro-electro-mechanical systems (MEMS) technologies and microelectronics manufacturing have made micro-electrostatic and micro-magnetic relays possible. Such micro-magnetic relays typically include an electromagnet that, when energized, causes a lever to make or break an electrical contact. When the magnet is de-energized, a spring or other mechanical force typically restores the lever to a quiescent position. Such relays typically exhibit a number of marked disadvantages, such as they are bulky in size, heavy, slow, expensive, and difficult to manufacture and integrate. Also, the spring required by conventional micro-magnetic relays may degrade or break over time.

Another micro-magnetic relay includes a permanent magnet and an electromagnet for generating a magnetic field that intermittently opposes the field generated by the permanent magnet. One drawback is that the relay must consume power from the electromagnet to maintain at least one of the output states. Moreover, the power required to generate the opposing field is significant, thus making the relay less desirable for use in space, portable electronics, and other applications that demand low power consumption.

Exemplary micro-magnetic switches are further described in international patent publications U.S. Pat. No. 6,469,602 ("the 602 patent") that issued Oct. 22, 2002, entitled "Electronically Switching Latching Micro-magnetic Relay And Method of Operating Same," and U.S. Pat. No. 6,496,612 ("the 612 patent") that issued Dec. 17, 2002, entitled "Electronically Micro-magnetic latching switches and Method of Operating Same," both to Ruan et al., are both incorporated by reference herein in their entireties.

Therefore, what is needed is a non-latching micro magnetic switch that can consume low power, be small, fast, and be easy to integrate. The switch can also be reliable, simple in design, low-cost, easy to manufacture, and useful in optical and/or electrical environments.

BRIEF SUMMARY OF THE INVENTION

The non-latching micro-magnetic switches of the present invention can be used in a plethora of products including household and industrial appliances, consumer electronics, military hardware, medical devices, vehicles of all types, just to name a few broad categories of goods. The non-latching micro-magnetic switches of the present invention have the advantages of compactness, simplicity of fabrication, and have good performance at high frequencies.

Embodiments of the present invention provide a non-latching micro magnetic switch that includes a reference plane and a magnet located proximate to a supporting structure. The magnet produces a first magnetic field with uniformly spaced field lines approximately orthogonal to the reference plane, symmetrically spaced about a central axis, or non-uniformly spaced fields approximately orthogonal to the reference plane. The switch also includes a cantilever supported by the support structure. The cantilever has an axis of rotation lying in the reference plane and has magnetic material that makes the cantilever sensitive to the first magnetic field, such that the cantilever is configured to rotate about the axis of rotation between first and second states. The switch further includes a conductor located proximate to the supporting structure and the cantilever. The conductor is configured to conduct a current. The current produces a second magnetic field having a component approximately parallel to the reference plane and approximately perpendicular to the rotational axis of the cantilever, which causes the cantilever to switch between the first and second states. The switch still further includes a stopping device located proximate to the supporting structure. The stopping device is operable to stop the cantilever from rotating about the axis of symmetry beyond a point at which a longitudinal axis of the cantilever is approximately parallel to a longitudinal axis of the magnet.

Other embodiments of the present invention provide a non-latching micro magnetic switch including a reference plane and a magnet located proximate to a supporting structure. The magnet produces a first magnetic field with uniformly spaced field lines at obtuse angles with respect to the reference plane. The switch also includes a cantilever supported by the supporting structure. The cantilever has an axis of rotation lying in the reference plane and has a magnetic material that makes the cantilever sensitive to the first magnetic field, such that the cantilever can rotate about the axis of rotation between first and second states. The switch further includes a conductor located proximate to the supporting structure and the cantilever. The conductor is configured to conduct a current. The current produces a second magnetic field having a component approximately parallel to the reference plane and approximately perpendicular to the rotational axis of the cantilever, which causes the cantilever to switch between the first and second states.

Further embodiments, features, and advantages of the present inventions, as well as the structure and operation of the various embodiments of the present invention, are described in detail below with reference to the accompanying drawings.

BRIEF DESCRIPTION OF THE DRAWINGS/FIGURES

The accompanying drawings, which are incorporated herein and form a part of the specification, illustrate the present invention and, together with the description, further serve to explain the principles of the invention and to enable a person skilled in the pertinent art to make and use the invention.

Figure 5:
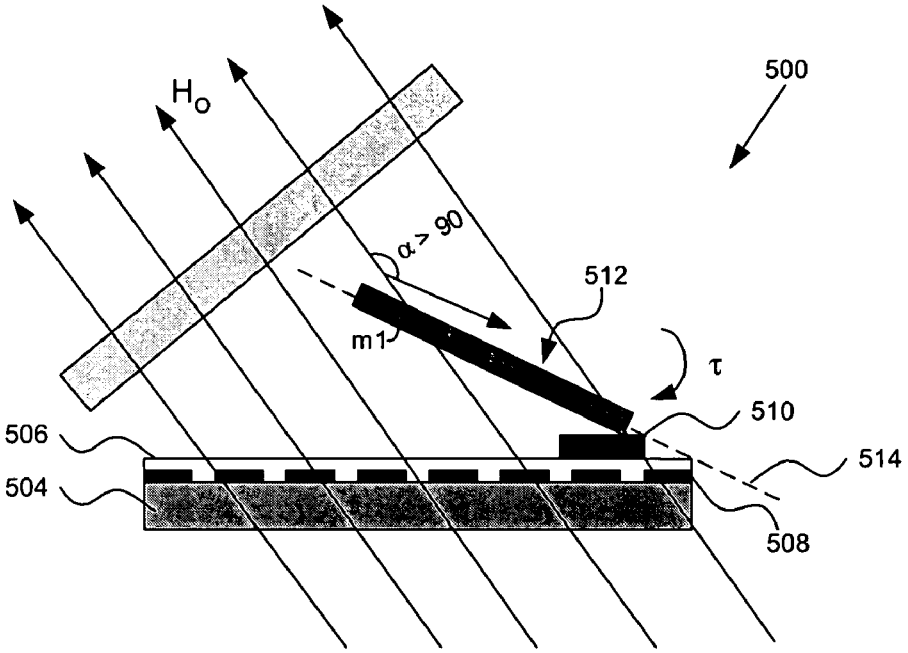
Figure 6:
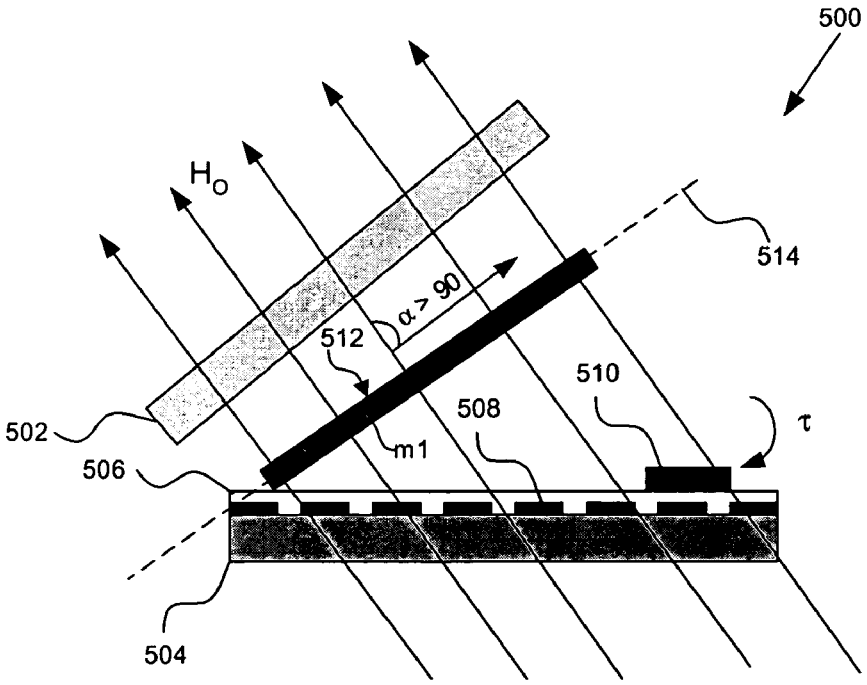
Figure 7:
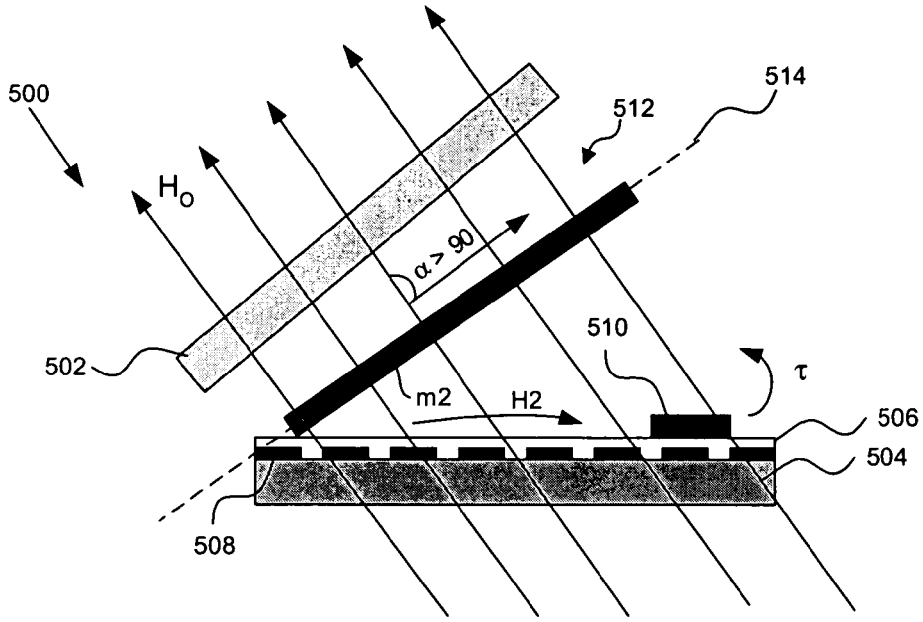

FIGS. 5, 6, and 7 show cross-sectional views during various states of a non-latching micro magnetic switch according to an embodiment of the present invention.

Figure 8:
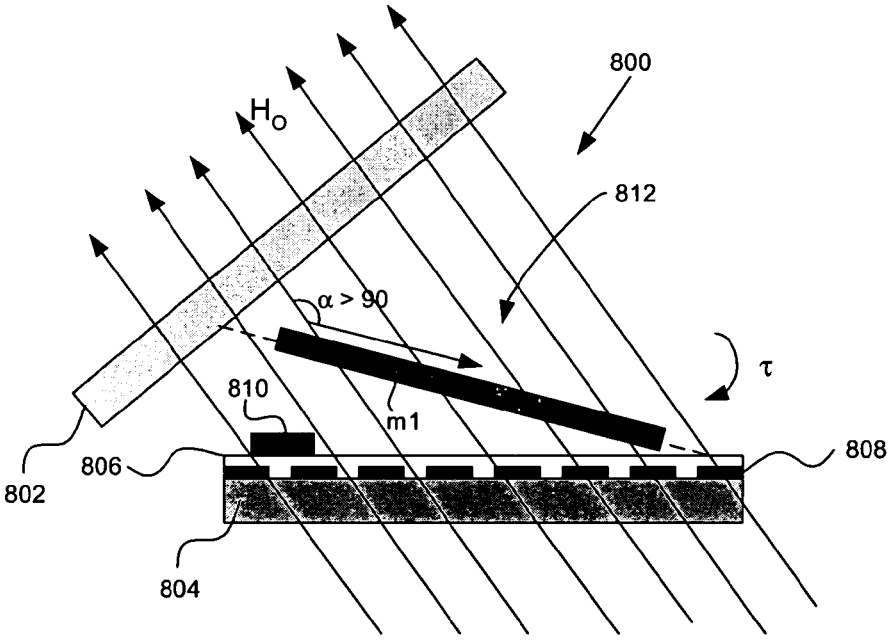

FIG. 8 shows a cross-sectional view of a non-latching micro magnetic switch according to an embodiment of the present invention.

Figure 9:
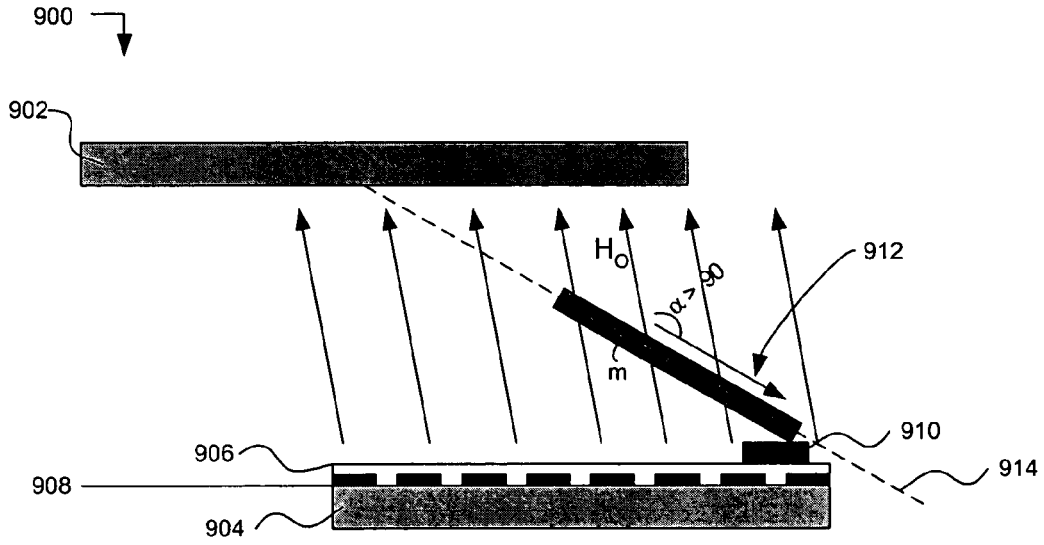

FIG. 9 shows a cross-sectional view of a non-latching micro magnetic switch according to an embodiment of the present invention.

The present invention will now be described with reference to the accompanying drawings. In the drawings, like reference numbers may indicate identical or functionally similar elements. Additionally, the left-most digit(s) of a reference number may identifys the drawing in which the reference number first appears.

DETAILED DESCRIPTION OF THE INVENTION

It should be appreciated that the particular implementations shown and described herein are examples of the invention, and are not intended to otherwise limit the scope of the present invention in any way. Indeed, for the sake of brevity, conventional electronics, manufacturing, MEMS technologies, and other functional aspects of the systems (and components of the individual operating components of the systems) may not be described in detail herein. Furthermore, for purposes of brevity, the invention is frequently described herein as pertaining to micro-machined switches for use in electrical or electronic systems. It should be appreciated that many other manufacturing techniques could be used to create the switches described herein, and that the techniques described herein could be used in mechanical switches, optical switches, or any other switching device. Further, the techniques would be suitable for application in electrical systems, optical systems, consumer electronics, industrial electronics, wireless systems, space applications, or any other application. Moreover, it should be understood that the spatial descriptions (e.g., "above", "below", "up", "down", etc.) made herein are for purposes of illustration only, and that practical latching switches may be spatially arranged in any orientation or manner. Arrays of these switches can also be formed by connecting them in appropriate ways and with appropriate devices and/or through integration with other devices, such as transistors.

The discussion below is directed to one type of switch, which can be called a non-latching, single state, and/or single latching switch. This is because the switch is stable in only one of two states, and only remains in the non-stable state for a temporary time period, normally remaining in the stable state. These above terms are used interchangeably throughout.

FIGS. 1–9 show portions of a non-latching switch, but for brevity do not include all aspects of the switch required for operation (e.g., pivot points for a cantilever, etc.). The exemplary switches in the '602 and '612 patents are incorporated by reference herein in their entireties to teach any aspects that may not be specifically shown or described in the instant specification.

Non-Latching Switches

Figure 1:
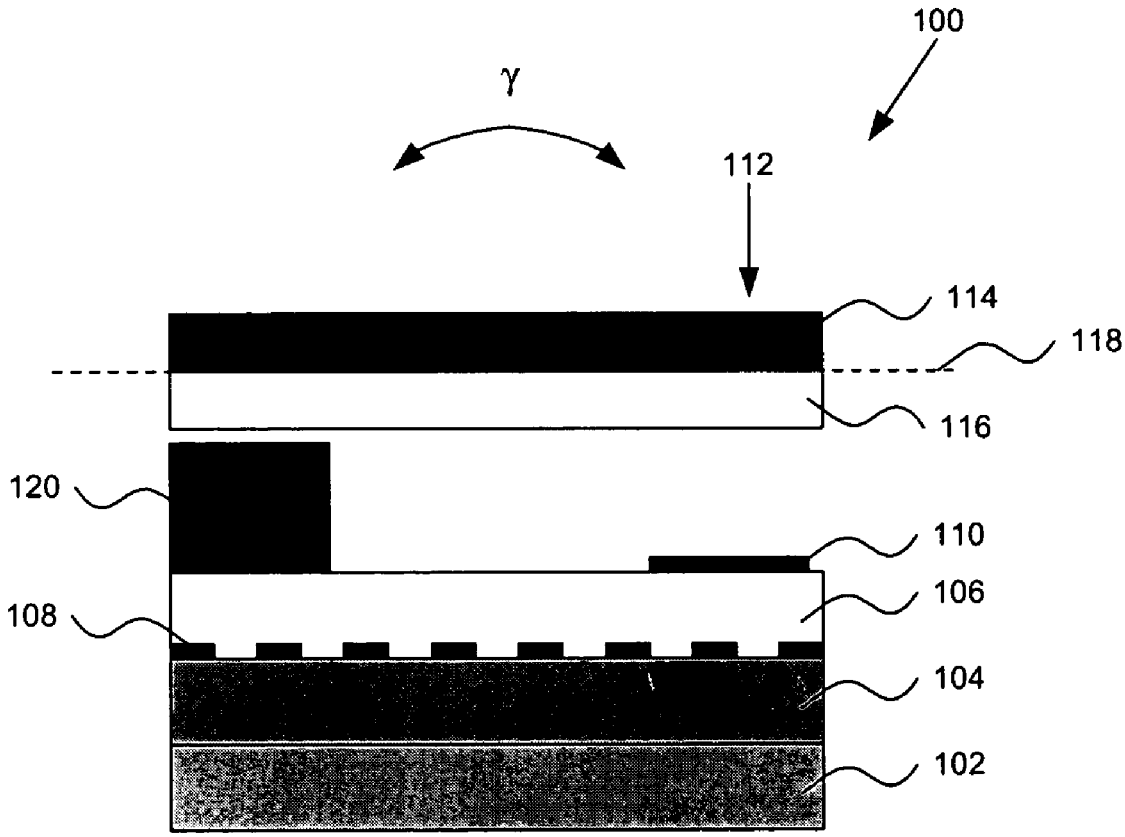
FIG. 1 shows a cross-sectional view of a non-latching micro magnetic switch according to an embodiment of the present invention.

FIG. 1 illustrates a cross-sectional view of a switch 100 according to an embodiment of the present invention. Switch 100 includes a permanent magnet 102, a substrate 104, a dielectric layer 106, a first conductor (e.g., coil) 108, a second conductor (e.g., contact) 110, and a cantilever 112. Cantilever 112 can include at least a magnetic layer 114 and a conducting layer 116. Substrate 104 can also include a stopping device 120. Various magnetic fields $H_0$, such as those shown in FIGS. 2–4, can be used for switch 100. Stopping device 120 allows switch 100 to be considered a single latching, single state, and/or non-latching micro-magnetic switch. This is because during conduction of a current through first conductor 108, cantilever 112 cannot rotate beyond a point where longitudinal axis 118 is substantially or approximately perpendicular to at least one magnetic field line of the magnetic fields in FIGS. 2–4. Hence, switch 100 cannot move into a second, stable state.

In an embodiment, switch 100 latches ON in a first, stable state when conductor 108 is not conducting current. Switch 100 latches OFF in a second state when conductor 108 is conducting current. However, switch 100 requires the current to be conducting to remain OFF (e.g., open) because stopper 120 prevents switch 100 from entering a second, stable state. As soon as the current stops conducting, switch 100 latches ON after returning to the first, stable state. This configuration is considered non-latching because power is required to keep switch 100 in the second state.

Exemplary Magnetic Fields

Figure 2:
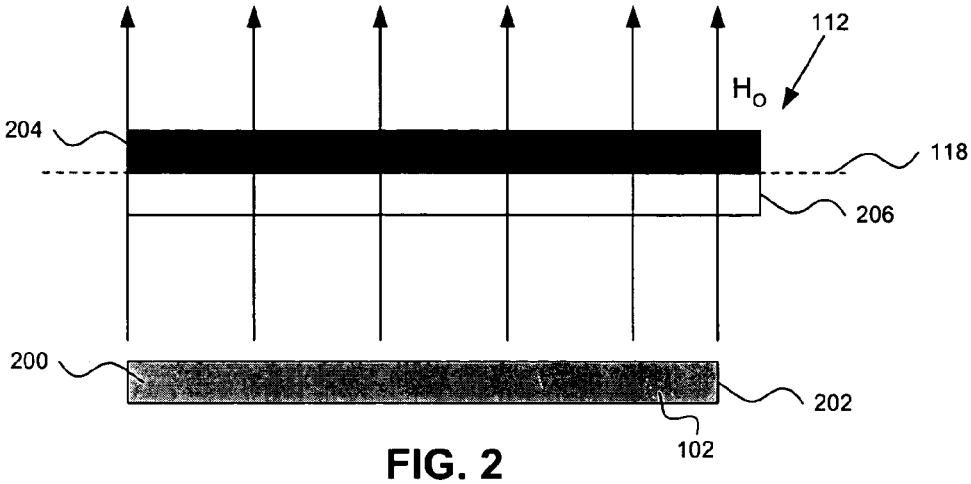
FIGS. 2–4 show example magnetic fields for a non-latching micro magnetic switch according to embodiments of the present invention.

FIG. 2 illustrates a magnetic field (e.g., $H_0$) according to an embodiment of the present invention. The magnetic field is uniformly perpendicular to longitudinal axis 118 of cantilever 112. This is considered an ideal field, and is usually caused by permanent magnet 102 being substantially or approximately parallel to longitudinal axis 118 and when ends 200, 202 of permanent magnet 102 are aligned with ends 204, 206 of cantilever 112. A stable state can be when cantilever 112 is interacting with contact 110 and an unstable, temporary second state can be when cantilever 112 is not interacting with contact 110.

In operation, an induced magnetic moment in cantilever 112 can point to the left when a torque ($\tau = m \times B$) is clockwise placing cantilever 112 in the first state. The cantilever 112 will stay in the first state unless external influence is introduced. This external influence can be when current is conducted in a first direction through first conductor 108, which causes a second magnetic field. The second magnetic field induces a second moment, which causes the torque to become counter-clockwise. Thus, to move switch 100 to the second state, the current flowing in the first direction through first conductor 108 produces the second magnetic field. The second magnetic field can point dominantly to the right at cantilever 112, re-magnetizing cantilever 112, such that its magnetic moment points to the right. The torque between the right-pointing moment and $H_0$ produces the counter-clockwise torque, forcing cantilever 112 to rotate to the second state. When the current through first conductor 108 stops, the second magnetic field not longer exists. After this occurs, cantilever 112 returns to the first state based on stopping device 120 keeping cantilever 112 from rotating beyond a certain point, as described above.

Figure 3:
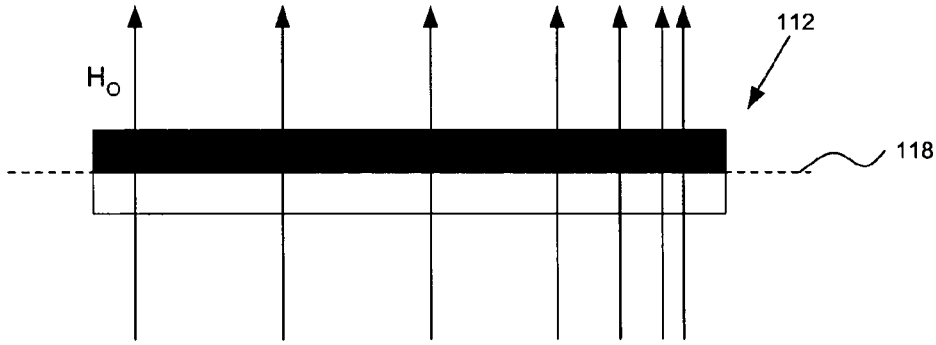

FIG. 3 illustrates a magnetic field (e.g., $H_0$) according to an embodiment of the present invention. The magnetic field has non-uniform spacing between field lines, but is perpendicular to longitudinal axis 118 of cantilever 112. The magnetic field lines are closest together on the right side, which indicates the strongest area of the magnetic field is on the right side. The magnetic field in FIG. 3 can result in the same operations for switch 100 as described above for FIG. 2.

Figure 4:
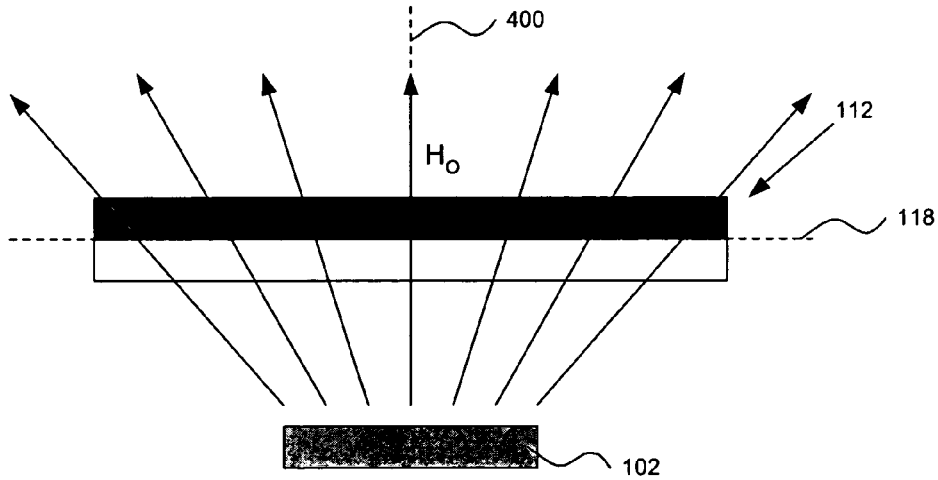

FIG. 4 illustrates a magnetic field (e.g., $H_0$) according to an embodiment of the present invention. The magnetic field is symmetrical about a central axis 400 of cantilever 112, but not completely perpendicular to longitudinal axis 118 of cantilever 112. This magnetic field can be caused by a non-ideal placement of permanent magnet 102 or a relatively small magnet placed along a central point of longitudinal axis 118 of cantilever 112. This can also be caused by a size of permanent magnet 102 or another magnet. The magnetic field in FIG. 4 can result in the same operations for switch 100 as described above for FIG. 2.

Operation of Exemplary Non-Latching Switches

FIGS. 5–7 illustrate cross-sectional views of an exemplary non-latching switch 500 during operation of switch 500 according to embodiments of the present invention. Switch 500 includes a permanent magnet 502, a substrate 504, a dielectric layer 506, a first conductor (e.g., a coil) 508, a second conductor (e.g., a contact) 510, and a cantilever 512. Cantilever 512 can include at least a magnetic layer and a conducting layer. Again, switch 500 is non-latching because it only has a first, stable state in which it remains unless influenced to momentarily switch to a second, unstable state before returning to the first, stable state. Thus, because the switch 500 does not stay in the second, unstable state more than momentarily, it is considered a non-latching switch.

FIG. 5 illustrates a normally ON state (i.e., cantilever 512 interacts with second conductor 510, closing switch 500, and turning switch 500 ON). The induced magnetic moment m1 in the cantilever 512 points to left and a torque ($\tau = m \times B$, where $\tau$ is a torque value based on a moment m and a magnetic flux density B) is clockwise. Cantilever 512 will stay in this position unless an external influence is introduced.

FIG. 6 illustrates an unstable state. The induced magnetic moment ml in cantilever 512 points to the left and the torque ($\tau = m \times B$) is still clockwise. Cantilever 512 will return to the stable state shown in FIG. 5.

FIG. 7 illustrates an unstable state and a normally "OFF" state (i.e., cantilever 512 stops interacting with second conductor 510, opening switch 500, and turning switch 500 OFF). A current is passed through first conductor (e.g., coil) 508 producing a second magnetic field, which induces a moment m2 in cantilever 512 pointing to the right. During this time period, the torque becomes counter-clockwise, which keeps cantilever 512 in an OFF state.

With continuing reference to FIGS. 5–7, cantilever 512 only has one stable position, shown in FIG. 5 (e.g., the ON state, since cantilever 512 interacts with second conductor 510). This is because the angle ($\alpha$) between the permanent magnetic field ($H_0$) and longitudinal axis 514 is usually larger than 90° (although this might not be easily seen in these figures). The static magnetic field ($H_0$) provided by permanent magnet 502 almost always has a left-pointing projected component on longitudinal axis 514 of cantilever 512. As shown in FIG. 7, to switch the switch 500 OFF, a current through first conductor 508 produces a second magnetic field ($H_2$) pointing dominantly to the right at cantilever 512, which re-magnetizes cantilever 512 so that its magnetic moment ($m_2$) points to the right. The torque between the right-pointing moment ($m_2$) and $H_0$ produces a counter-clockwise torque, forcing cantilever 512 to rotate to the OFF state shown in FIG. 7. When the current through first conductor 508 stops, $H_2$ disappears and the $H_0$-induced moment points to the left again (unstable state shown in FIG. 6). Then, cantilever 512 returns to the stable ON state shown in FIG. 5.

FIG. 8 shows a cross-sectional view of a switch 800 according to embodiments of the present invention. Switch 800 is in a normally OFF state. Switch 800 includes a permanent magnet 802, a substrate 804, a dielectric layer 806 with a first conductor (e.g., coil) 808, a second conductor (e.g., a contact) 810, and a cantilever 812. Cantilever 812 can include at least a magnetic layer and a conducting layer. The normally OFF state can be based on either placing contact 810 on an opposite end of cantilever 812 as compared to cantilever 512, or by tilting the magnetic field $H_0$ slightly toward the right, which causes m1 to be in the direction shown. Thus, operation of switch 800 is similar to switch 500 discussed above.

FIG. 9 shows a switch 900 according to an embodiment of the present invention. Switch 900 includes a permanent magnet 902, a substrate 904, a dielectric layer 906, a first conductor (e.g., a coil) 908, a second conductor (e.g., a contact) 910, and a cantilever 912. Cantilever 912 can include at least a magnetic layer and a conducting layer. Cantilever 912 can be placed off-center from permanent magnet 902, such that a magnetic field in the cantilever region is not completely approximately perpendicular to a longitudinal axis 914 of cantilever 912. Thus, this magnetic field produces one stable state without applying current through first conductor 908.

Existing systems can easily be modified to replace existing switches having the undesirable characteristics discussed above with the switches according to embodiments of the present invention. Thus, existing products can benefit from advantages provided by using the non-latching switches manufactured according to embodiments of present invention. Some of those advantages of the switches are their compactness, simplicity of fabrication and design, good performance at high frequencies, reliability, and low-cost.

CONCLUSION

While various embodiments of the present invention have been described above, it should be understood that they have been presented by way of example only, and not limitation. It will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the following claims and their equivalents.

What is claimed is:

1. A latching micro magnetic switch, the switch comprising:

a reference plane;

a magnet, located proximate to a supporting structure, the magnet producing a first magnetic field with uniformly spaced field lines at obtuse angles with respect to the reference plane;

a cantilever, supported by the supporting structure, having an axis of rotation lying in the reference plane, and having a magnetic material that makes the cantilever sensitive to the first magnetic field, such that the cantilever can rotate about the axis of rotation between first and second states; and a conductor, located proximate to the supporting structure and the cantilever, configured to conduct a current, wherein the current produces a second magnetic field having a component approximately parallel to the reference plane and approximately perpendicular to the rotational axis of the cantilever, which causes the cantilever to switch between the first and second states.

2. The switch of claim 1, wherein once switched to a one of the first and second states, the cantilever is latched in the one of the first and second states by the first magnetic field until further switching occurs.

3. The switch of claim 1, wherein the conductor and the cantilever are formed on the supporting structure.

4. The switch of claim 1, wherein the cantilever is provided between the substrate and the magnet.

5. The switch of claim 1, wherein a magnitude of the second magnetic field is smaller than a magnitude of the first magnetic field.

6. The switch of claim 1, wherein the supporting structure is positioned between the cantilever and the magnet.

7. The switch of claim 1, wherein the supporting structure is a substrate.

8. The switch of claim 1, wherein:

the first state is an ON state; and the second state is an OFF state.

9. The switch of claim 1, wherein:

the first state is an OFF state; and the second state is an ON state.

10. The switch of claim 1, wherein a longitudinal axis of the permanent magnet is at an acute angle within respect to a longitudinal axis of the supporting structure.

11. The switch of claim 1, wherein a longitudinal axis of the permanent magnet is substantially parallel to a longitudinal axis of the supporting structure.

12. The switch of claim 1, wherein one of the first and second states is a temporary state.

* * * * *